US011000089B2

(12) United States Patent
Ikeda

(10) Patent No.: US 11,000,089 B2
(45) Date of Patent: May 11, 2021

(54) HELMET

(71) Applicant: SHOEI CO., LTD., Tokyo (JP)

(72) Inventor: Yoshiyuki Ikeda, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 355 days.

(21) Appl. No.: 14/286,038

(22) Filed: May 23, 2014

(65) Prior Publication Data

US 2015/0000012 A1 Jan. 1, 2015

(30) Foreign Application Priority Data

Jun. 27, 2013 (JP) ..... JP2013-135209

(51) Int. Cl.
*A42B 3/10* (2006.01)
*A42B 3/28* (2006.01)
*A42B 3/12* (2006.01)

(52) U.S. Cl.
CPC ..... *A42B 3/281* (2013.01); *A42B 3/10* (2013.01); *A42B 3/12* (2013.01)

(58) Field of Classification Search
CPC ..... A42B 3/281; A42B 3/28; A42B 3/283; A42B 3/10
USPC ..... 2/411, 412, 425
See application file for complete search history.

(56) References Cited

U.S. PATENT DOCUMENTS 2,634,415 A * 4/1953 Turner ..... A42B 3/12 2/414
4,115,874 A * 9/1978 Hasegawa ..... A42B 3/281 2/171.3
4,519,099 A * 5/1985 Kamiya ..... A42B 3/227 2/171.3
4,700,411 A * 10/1987 Kawasaki ..... A42B 3/283 2/171.3

(Continued)

FOREIGN PATENT DOCUMENTS

DE 9408108 9/1994
EP 0903086 3/1999

(Continued)

OTHER PUBLICATIONS

Search report from E.P.O., dated Oct. 7, 2014.

*Primary Examiner* — Alissa J Tompkins
*Assistant Examiner* — Catherine M Ferreira
(74) *Attorney, Agent, or Firm* — Greenblum & Bernstein P.L.C.

(57) ABSTRACT

A helmet which performs good ventilation and which is capable of mitigating the uncomfortable feeling due to sound is provided. The shock absorbing liner includes front ventilation holes to communicatively connect the front openings to the inside of the shock absorbing liner, outside air paths disposed in a space on an outer side relative to an inner surface of the shock absorbing liner, and communicative holes to communicatively connect the inside of the shock absorbing liner to the outside air paths. The outside air paths include primary flow paths disposed to be connected (Continued)

to the rear opening and secondary flow paths. The communicative holes communicatively connects positions on an outer surface of the shock absorbing liner except positions of the primary flow paths, to the inside of the shock absorbing liner. The secondary flow paths are disposed to connect the communicative holes to the primary flow paths.

7 Claims, 8 Drawing Sheets

(56) References Cited

U.S. PATENT DOCUMENTS

| | | | | | |
|---|---|---|---|---|---|
| 5,068,922 | A * | 12/1991 | Zahn | F41H 1/04 | 2/411 |
| 5,345,614 | A * | 9/1994 | Tanaka | A42B 3/281 | 2/171.3 |
| 5,867,840 | A * | 2/1999 | Hirosawa | A42B 3/281 | 2/414 |
| 5,937,446 | A * | 8/1999 | Fallert | A42B 3/124 | 2/411 |
| 6,094,750 | A * | 8/2000 | Lee | A42B 3/10 | 2/171.3 |
| 6,263,514 | B1 * | 7/2001 | Chern | A42B 3/044 | 2/410 |
| 6,405,382 | B2 * | 6/2002 | Shida | A42B 3/283 | 2/171.3 |
| 6,910,228 | B2 * | 6/2005 | Tanaka | A42B 3/283 | 2/171.3 |
| 7,475,434 | B2 * | 1/2009 | Ambuske | A42B 3/06 | 2/425 |
| 2005/0241048 | A1 * | 11/2005 | Cattaneo | A42C 2/00 | 2/412 |
| 2006/0031978 | A1 * | 2/2006 | Pierce | A42B 3/06 | 2/414 |
| 2011/0307997 | A1 * | 12/2011 | Blair | A42B 1/08 | 2/414 |

FOREIGN PATENT DOCUMENTS

| | | |
|---|---|---|
| GB | 1 255 305 | 12/1971 |
| JP | 751575 | 1/1974 |
| JP | 1965000 | 12/1994 |
| WO | 2008/085108 | 7/2008 |

* cited by examiner

HELMET

BACKGROUND OF THE INVENTION

Field of the Invention

The present invention relates to a helmet including an outer shell which has front openings and rear openings, and including air conduits or paths for ventilation inside.

In the present specification, directions associated with the helmet are defined based on the helmet wearer in an upright position, specifically, the side which the helmet user naturally faces is regarded as the front side and the other directions such as the rear direction, the right direction, and the left direction are accordingly defined.

Description of the Prior Art

Examples of a helmet in which air paths are disposed have been described in Japanese Patent Nos. 751575 and 1965000.

Japanese Patent No. 751575 describes a configuration of a helmet in which grooves are disposed on the outer surface of a shock absorbing liner such that the grooves and the inner surface of the shell configure air paths linked to a rear edge of the helmet, and communicative holes are disposed so as to communicatively connect the inner surface of the shock absorbing liner to those air paths.

Japanese Patent No. 1965000 describes a configuration of a helmet in which at least a part of a shock absorbing liner consists of an outer layer and an inner layer, air paths are formed on inner side of the combined layers, and communicative holes are disposed so as to communicatively connect the inner surface of the shock absorbing liner to those air paths.

SUMMARY OF THE INVENTION

However, in a situation wherein a motorcycle is running, when winds pass through the air paths disposed in the helmet, the wind noise, e.g., whistling sound is generated due to the air flow, leading to a fear that the sound causes uncomfortable feeling to the helmet wearer.

Also, for the inventions described in Japanese Patent Nos. 751575 and 1965000, there is a fear of the sound generated due to the air flow which passes from the air paths through the communicative holes into the inner surface of the shock absorbing liner. In those inventions, no consideration has been given to measures to suppress the sound.

It is therefore an object of the present invention, which has been made under these circumstances, to provide a helmet which performs good ventilation and which is capable of mitigating the uncomfortable feeling due to the sound.

To achieve the object in accordance with the present invention, there is provided a helmet, comprising a hard shell and a shock absorbing liner disposed in an inside of the shell, the shell comprising front openings and a rear opening, the shock absorbing liner comprising front ventilation holes to communicatively connect the front openings to the inside of the shock absorbing liner, outside air paths disposed in a space on an outer side relative to an inner surface of the shock absorbing liner, and communicative holes to communicatively connect the inside of the shock absorbing liner to the outside air paths, the outside air paths comprising primary flow paths disposed to be connected to the rear opening and secondary flow paths, the communicative holes communicatively connecting portions with the exception of the primary flow paths on an outer surface of the shock absorbing liner, to the inside of the shock absorbing liner, the secondary flow paths being disposed to connect the communicative holes to the primary flow paths.

In accordance with the present invention, it is possible to provide a helmet which performs good ventilation and which is capable of mitigating the uncomfortable feeling due to the sound generated due to the air flow.

BRIEF DESCRIPTION OF THE DRAWINGS

The objects and features of the present invention will become more apparent from the consideration of the following detailed description taken in conjunction with the accompanying drawings in which.

DESCRIPTION OF THE EMBODIMENTS

Referring next to the drawings, description will be given in detail of an embodiment in which a helmet in accordance with the present invention is applied to a full-face helmet.

Incidentally, the embodiment described below is only an example of the helmet in accordance with the present invention. The configuration of the helmet is not limited to the contour and the arrangement described below. It is to be understood that various changes may be made therein without departing from the spirit and scope of the present invention as defined within the claims.

Figure 1:
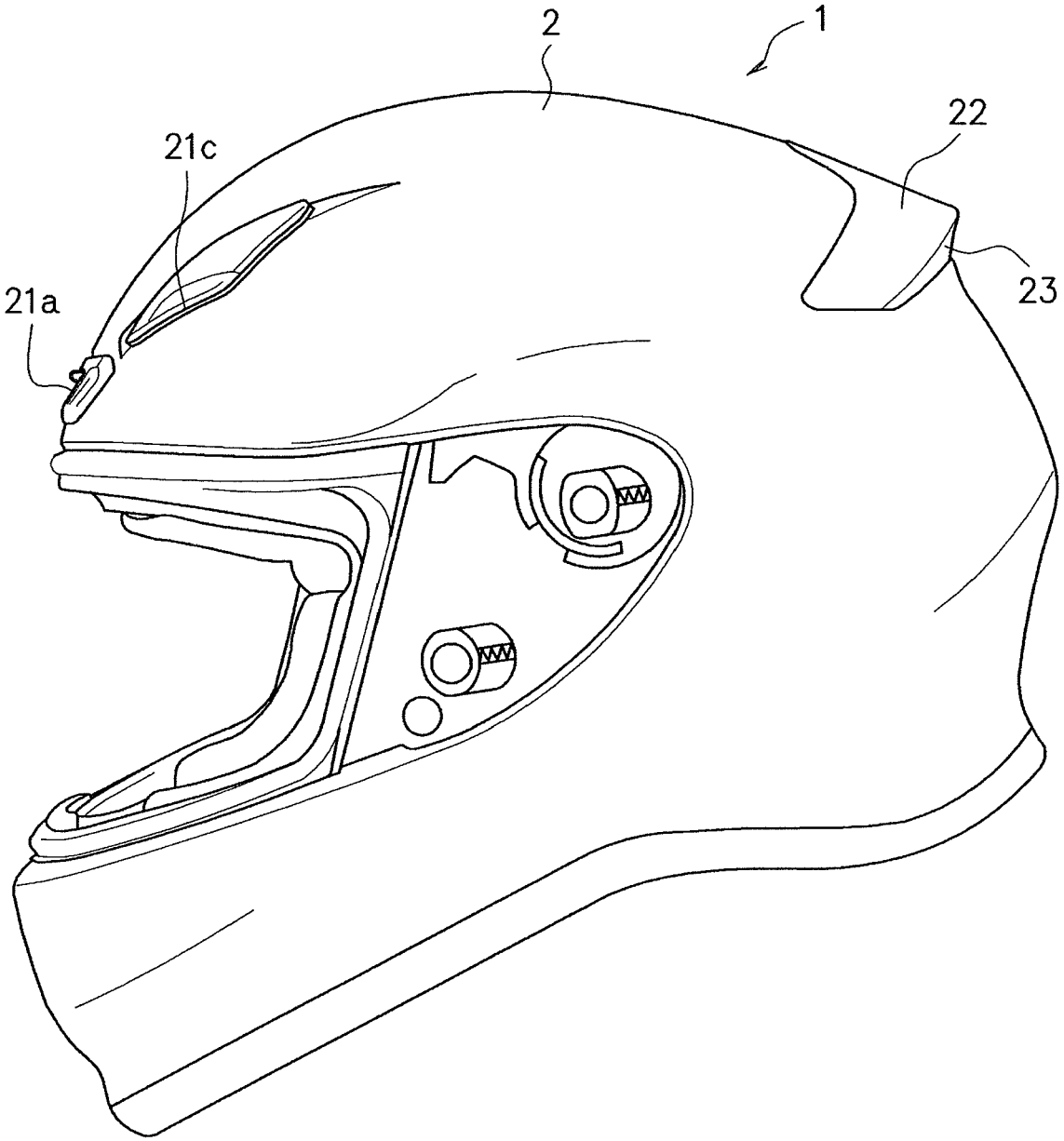
FIG. 1 is a side view showing an appearance of a helmet in an embodiment of the present invention.
Figure 2:
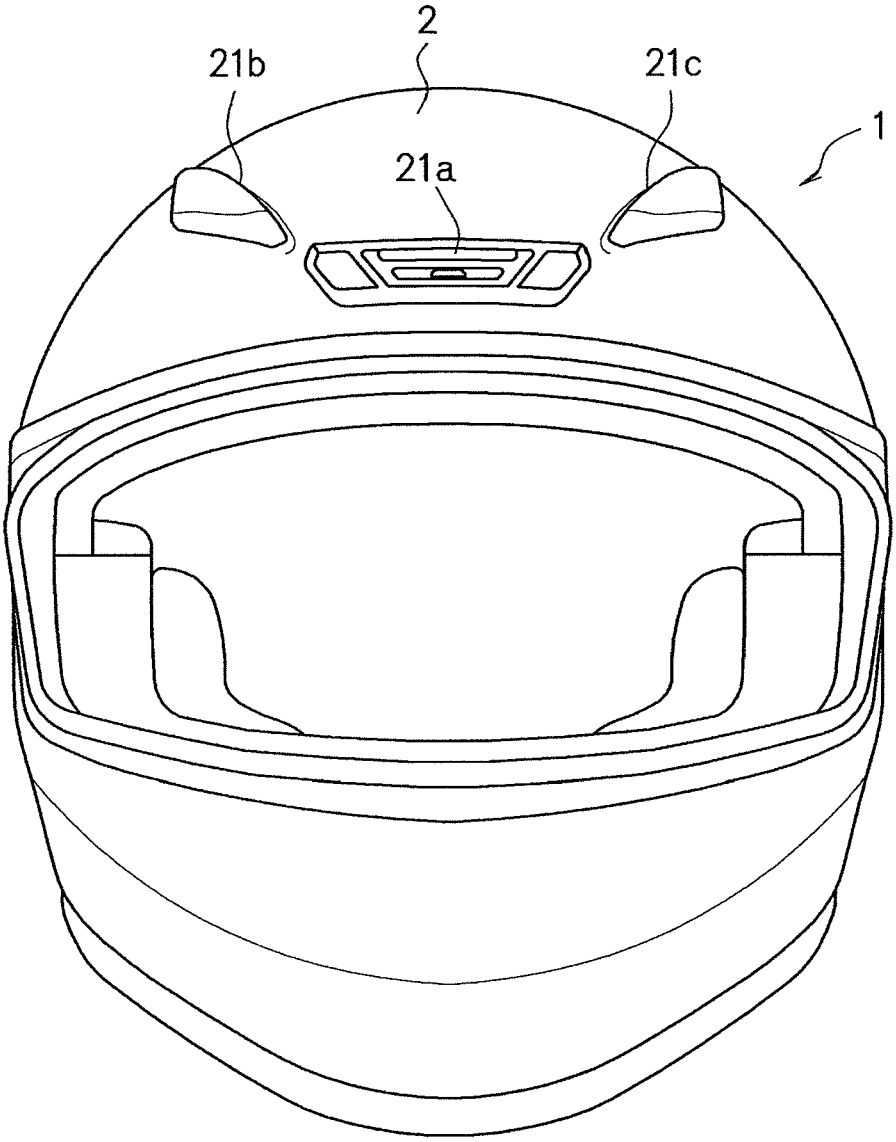
FIG. 2 is a front view showing an appearance of the helmet.
Figure 3:
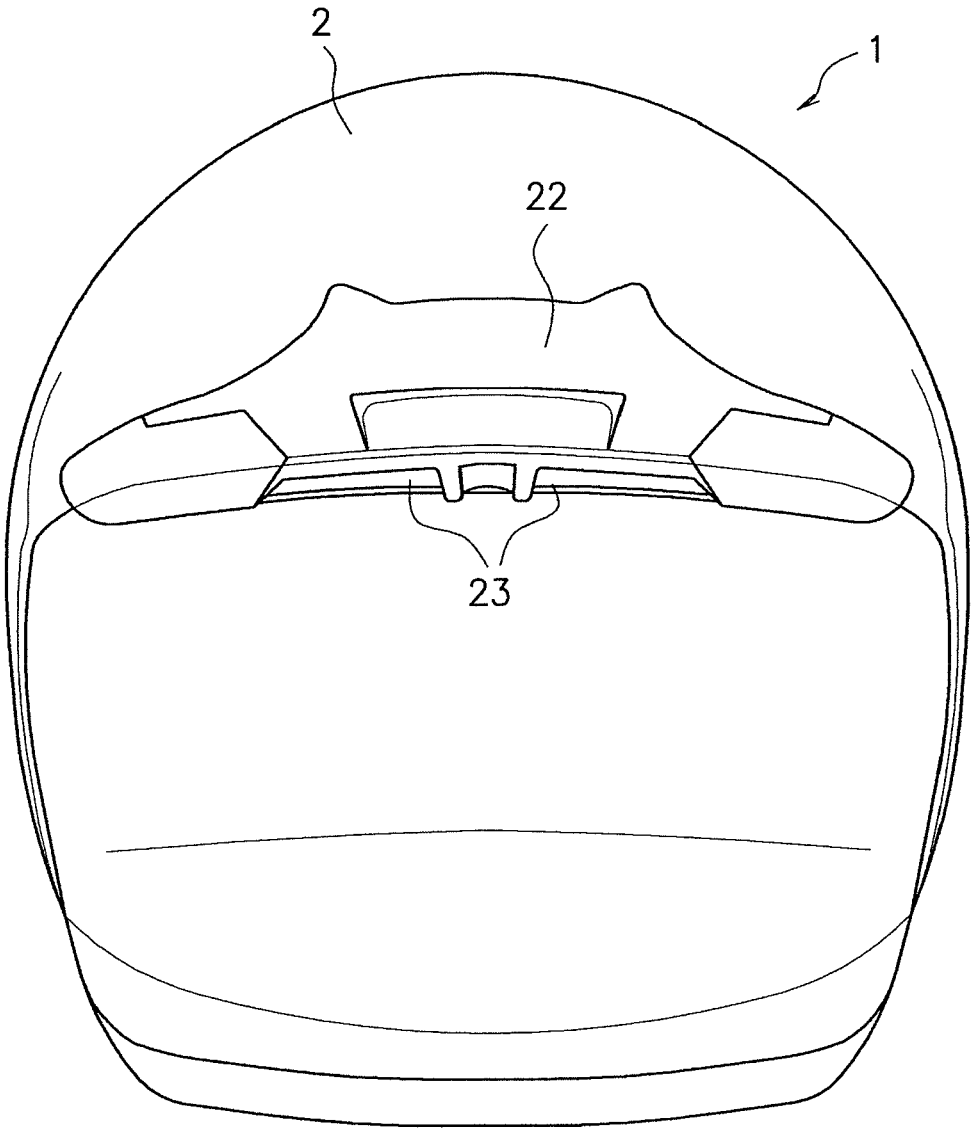
FIG. 3 is a rear view showing an appearance of the helmet.

FIGS. 1 to 3 show appearances of the helmet 1 in the present embodiment in which a windshield is removed from the helmet 1. FIGS. 4 to 8 show configurations of the shock absorbing liner 3.

The helmet 1 includes an outer shell including a hard shell 2. The shock absorbing liner 3 is fitted into the inner side of the hard shell 2. On the inner side of the sock absorbing liner 3, an elastic inner pad, not shown, is arranged to enhance comfortable feeling of the helmet 1 for the wearer.

On the front side of the shell 2, front openings 21 are disposed at positions above the window hole in which the windshield, not shown, is arranged. In the configuration example shown in FIGS. 1 and 2, three front openings 21*a*, 21*b*, 21*c*are disposed. However, the number and the positions of the front openings 21 may be appropriately designated according to the helmet designing and the like.

In at least one of the front openings 21, an adjusting unit to adjust the size or area of the opening such as a shutter, not shown, is disposed.

On the rear side of the shell 2, a rear spoiler 22 is arranged to adjust the air flow due to the air caused when the motorcycle is running. Just beneath the rear spoiler 22, a rear opening 23 is disposed.

When the wearer of the helmet 1 drives a motorcycle, air vortices appear below the rear spoiler 22 due to a travel stream. That is, the rear spoiler 22 serves a function to generate negative pressure in a direction from the rear opening 23 to the outside.

It is not limited that the rear spoiler 22 is disposed just above the rear opening 23. The rear spoiler 22 may be arranged at any position in the vicinity of the upper side of the rear opening 23 depending on the design. The position in the vicinity of the upper side of the rear opening 23 is favorably a position near the rear opening 23 and may be apart from the rear opening 23 if only it is possible to sufficiently generate the negative pressure.

The shell 2 is composed by a hard resinous material such as fiber reinforced plastics. Into the inner side of the shell 2, the shock absorbing liner 3 composed by an elastic material is fitted.

Figure 4:
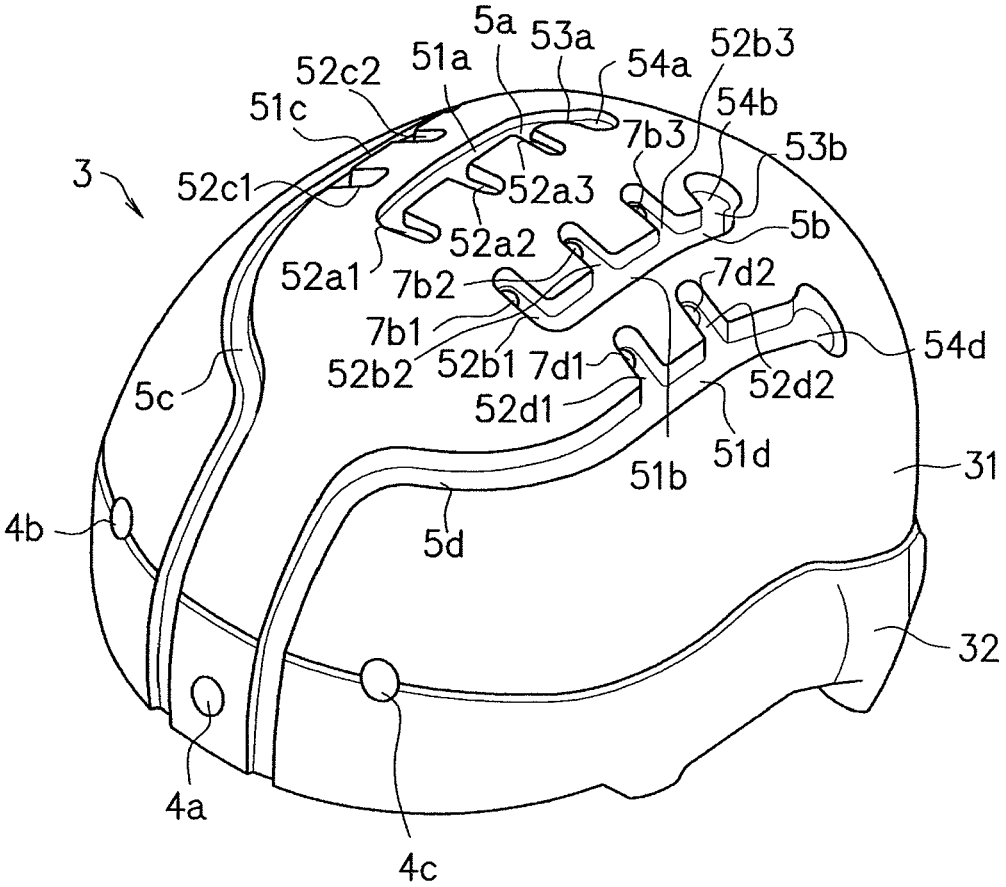
FIG. 4 is a perspective view showing a shock absorbing liner.
Figure 5:
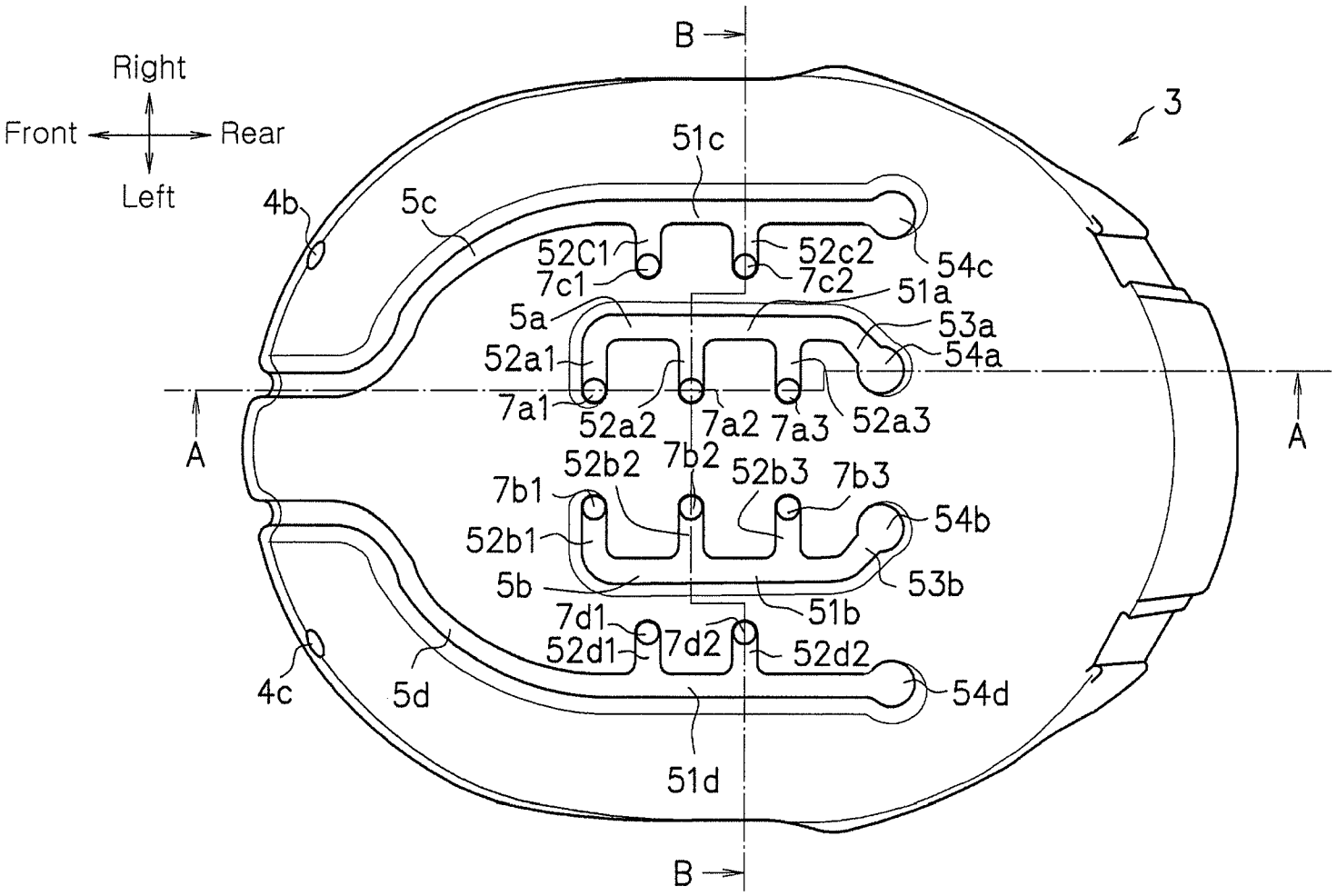
FIG. 5 is a diagram showing a contour of the shock absorbing liner viewed from above.
Figure 6:
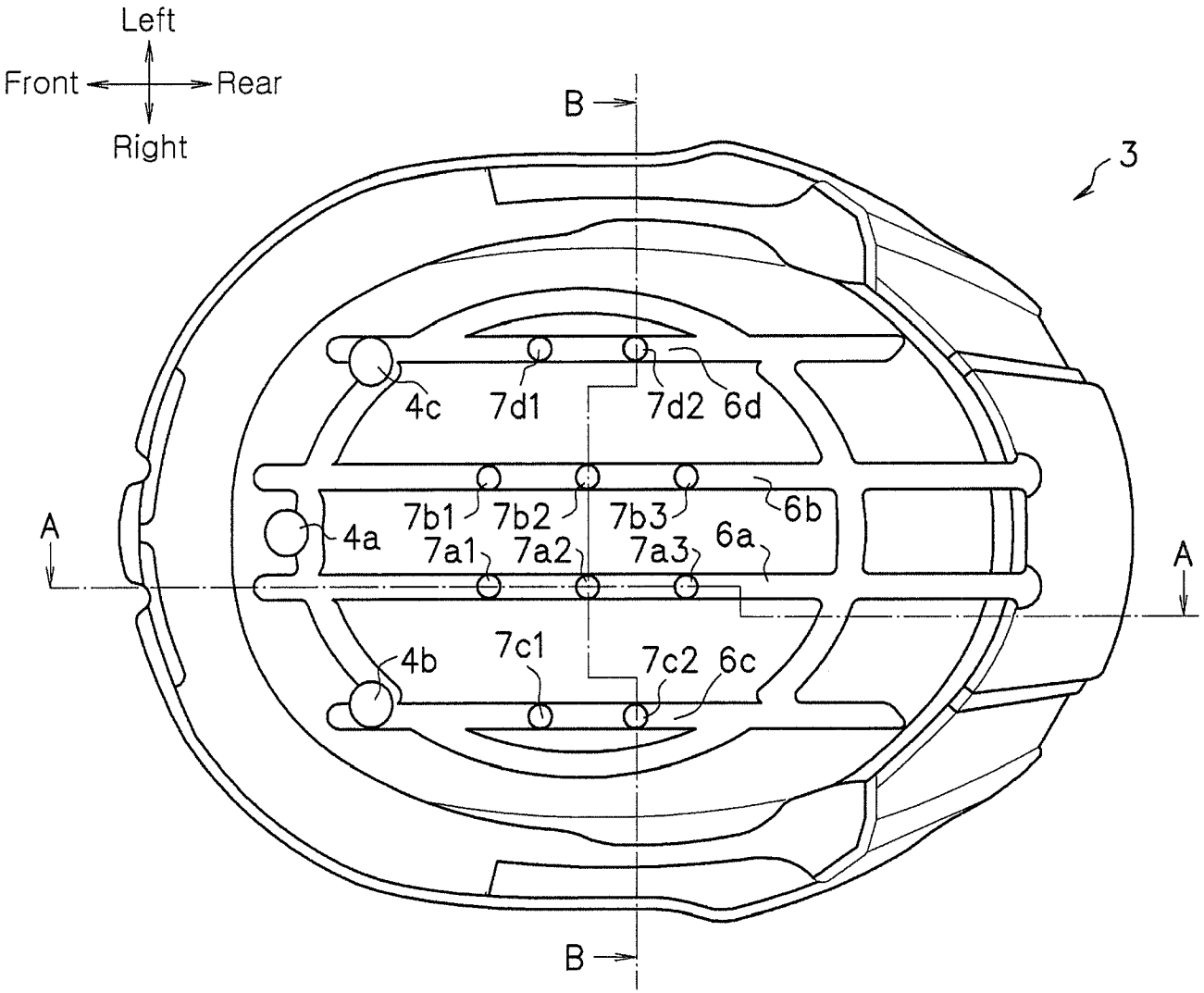
FIG. 6 is a diagram showing a contour of the shock absorbing liner viewed from underneath.
Figure 7:
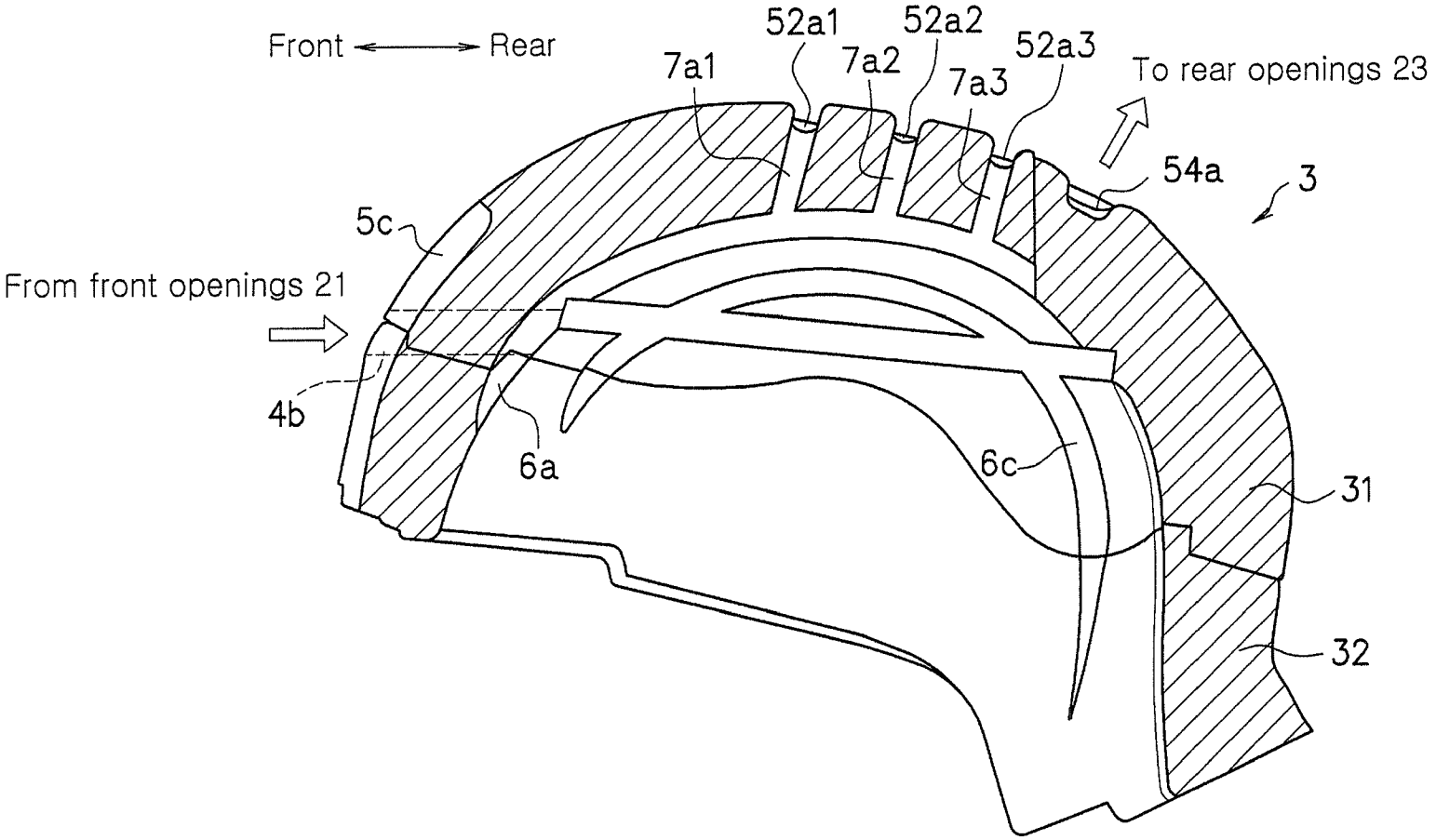
FIG. 7 is a cross-sectional diagram of the helmet taken along line A-A of the helmet shown in FIGS. 5 and 6.

FIG. 4 shows a state of the shock absorbing liner 3 viewed from above at an inclined direction, FIG. 5 shows a state of the shock absorbing liner 3 viewed from above, and FIG. 6 shows a state of the shock absorbing liner 3 viewed from underneath. FIG. 7 shows a cross section taken along line A-A of FIGS. 5 and 6 and FIG. 8 shows a cross section taken along line B-B of FIGS. 5 and 6.

On the front side of the shock absorbing liner 3, front ventilation holes 4 are disposed as shown in FIGS. 4, 6, and 7. The front ventilation holes 4 are arranged at positions respectively corresponding to the front openings 21 of the shell 2. In the configuration example of the present embodiment, the front ventilation holes 4*a*, 4*b*, 4*c* are disposed respectively corresponding to the front openings 21*a*, 21*b*, 21*c*.

Each of the front ventilation holes 4*a*, 4*b*, 4*c* is arranged such that the penetration direction, namely the flow path direction, thereof facilitates the airflow from the associated front openings 21 to the inside of the shock absorbing liner 3.

Figure 8:
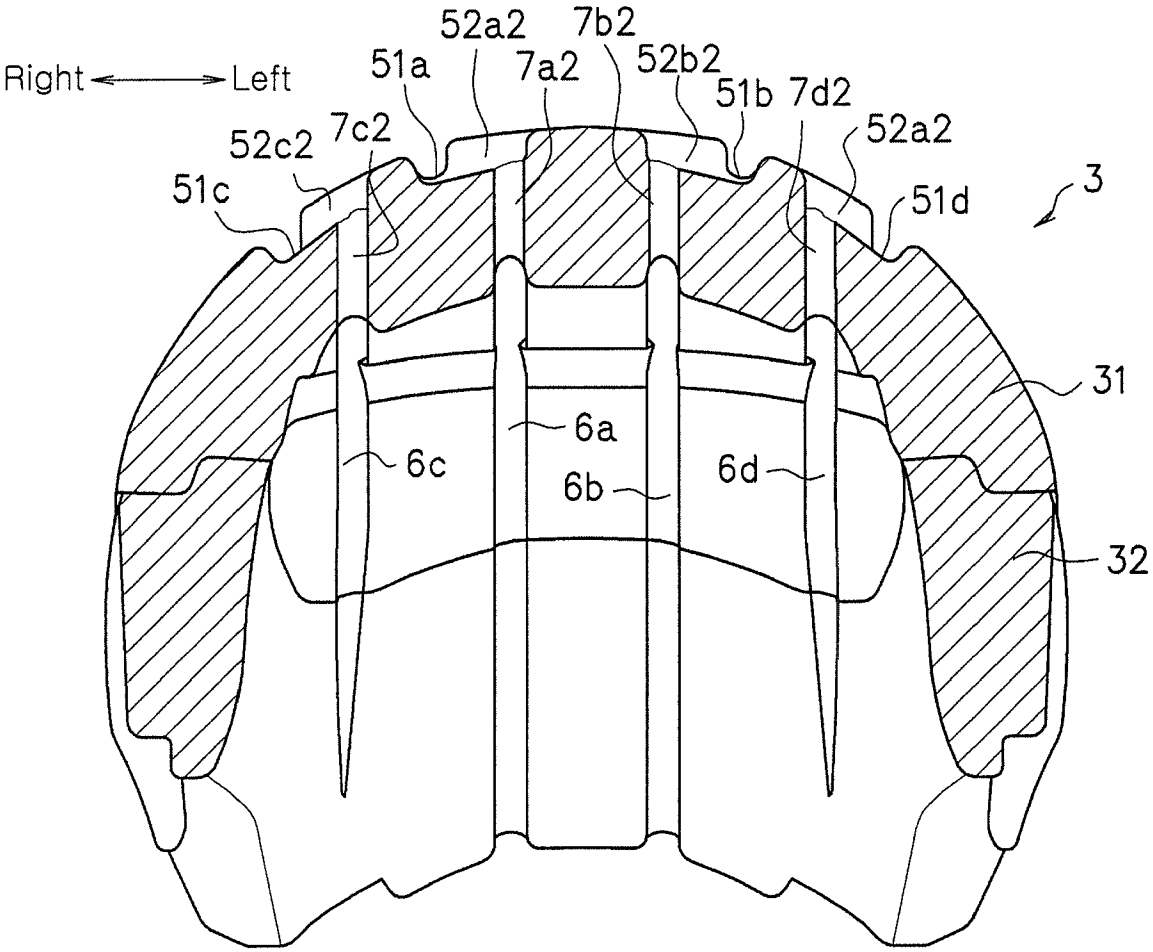
FIG. 8 is a cross-sectional diagram of the helmet taken along line B-B of the helmet shown in FIGS. 5 and 6

On the inner surface of the shock absorbing liner 3, inside grooves 6 are disposed in the direction from the front side to the rear side as shown in FIGS. 6 to 8. In the configuration example of the present embodiment, four inside grooves 6*a*, 6*b*, 6*c*, 6*d* are formed side by side.

When wearing the helmet 1, a space between the wearer's head and the inner pad, which is not shown, and is made contact with the head, and the inside grooves 6 configure inside air paths as inner spaces existing at an inner position when compared with the shock absorbing liner 3.

On the outer surface of the shock absorbing liner 3, outside grooves 5 are disposed as shown in FIGS. 4 and 5. Further, in the shock absorbing liner 3, communicative holes 7 are disposed as linear holes passing through the shock absorbing liner 3 to communicatively connect the bottoms of the inside grooves 6 to the outside grooves 5 as shown in FIGS. 4 to 8. In the configuration example of the present embodiment, four outside grooves 5*a*, 5*b*, 5*c*, 5*d* are disposed side by side.

The outside grooves 5*a*, 5*b*, 5*c*, 5*d*include primary flow paths 51*a*, 51*b*, 51*c*, 51*d*) and secondary flow paths 52*a*, 52*b*, 52*c*, 52*d*. The secondary flow paths 52 configure flow paths to connect outer openings of the communicative holes 7*a*1 , 7*a*2, 7*a*3, 7*b*1, 7*b*2, 7*b*3, 7*c*1, 7*c*2, 7*d*1, 7*d*2 to the primary flow paths 51.

The primary flow paths 51 constitute flow paths to connect at least the secondary flow paths 52 to the rear opening 23 disposed in the rear section of the shell 2. Hence, at edges on the rear side of the primary flow paths 51, rear edge connecting sections 54 are arranged to connect the flow paths to the rear opening 23 of the shell 2.

In the configuration example of the present embodiment, the outside grooves 5*c* and 5*d* are disposed on the both edge sides in the vertical direction, beginning at the edges on the front side of the shock absorbing liner 3 as shown in FIGS. 4 and 5. Since the outside grooves 5*c* and 5*d* are symmetrically configured to be almost the same to each other, description will be given of the outside groove 5*c*.

The outside groove 5*c* includes a primary flow path 51*c*, two secondary flow paths 52*c* (52*c*1, 52*c*2) and a rear edge connecting section 54*c* at an edge on the rear side.

The primary flow path 51*c* is disposed as a groove to form a flow path from the front edge of the shock absorbing liner 3 to the rear edge connecting section 54*c* at the rear edge. In a portion of the primary flow path 51*c* to which at least two secondary flow paths 52*c* (52*c*1, 52*c*2) are connected, the flow direction is equal to the longitudinal direction. Also, the secondary flow paths 52*c* are configured to flow direction in the vertical direction.

Hence, the secondary flow paths 52*c* branch from the primary flow path 51*c* in a direction perpendicular to the primary flow path 51*c*. The primary flow path 51*c* and the secondary flow paths 52*c* are configured as grooves substantially equal in depth and width to each other, and become wider at the rear edge connecting section 54*c* formed at the edge on the rear side in order to facilitate connection of the flow paths to the rear opening 23 in the rear section of the shell 2.

As FIGS. 7 and 8 show, the communicative holes 7 (7*c*1, 7*c*2) to be connected to the two secondary flow paths 52*c* (52*c*1, 52*c*2) are arranged as penetrated holes linearly extending from the inside to the outside of the shock absorbing liner 3. Hence, the flow path direction of the communicative holes 7 from the inside to the outside of the shock absorbing liner 3 is almost perpendicular to the direction of the secondary flow paths 52*c* along the surface contour of the shock absorbing liner 3.

In the configuration example of the present embodiment, the outside grooves 5*a* and 5*b* are disposed in the central section of the shock absorbing liner 3 in the vertical direction as shown in FIGS. 4 and 5. Since the outside grooves 5*a* and 5*b* are symmetrically configured to be almost the same to each other, description will be given of the outside groove 5*a*.

The outside groove 5*a* includes a primary flow path 51*a*, three secondary flow paths 52*a*1 , 52*a*2, 52*a*3 and a rear edge connecting section 54*a* at an edge on the rear side.

The primary flow path 51*a* is disposed as a groove to form a flow path from the second flow path 52*a*1 nearest to the front edge to the rear edge connecting section 54*a* at the rear edge. In a portion of the primary flow path 51*a* to which three secondary flow paths 52*a*1, 52*a*2, 52*a*3 are connected, the flow direction is equal to the longitudinal direction. In a section of the primary flow path 51*a* in the proximity of the rear edge connecting section 54*a* at the rear edge, there is formed a rear inflection 53*a* in which the flow path is bent about 45° relative to the longitudinal direction.

Three secondary flow paths 52*a*1, 52*a*2, 52*a*3 are configured to flow air in the vertical direction.

Hence, the secondary flow paths 52*a* are configured as branches from the primary flow path 51*a*, the branches being flow paths having a direction perpendicular to the primary flow path 51*a*. The primary flow path 51*a* and the secondary flow paths 52*a* are configured as grooves substantially equal in depth and width to each other, and become wider at the rear edge connecting section 54*a* formed at the edge on the rear side in order to facilitate connection of the flow paths to the rear opening 23 in the rear section of the shell 2.

As FIGS. 7 and 8 show, the communicative holes 7*a*1, 7*a*2, 7*a*3, which will be connected to the three secondary flow paths 52*a*1, 52*a*2, 52*a*3, are arranged as penetrated holes linearly extending from the inside to the outside of the shock absorbing liner 3. Hence, the flow path direction of the communicative holes 7 from the inside to the outside of the shock absorbing liner 3 is almost perpendicular to the direction of the secondary flow paths 52*a* along the surface contour of the shock absorbing liner 3.

Next, description will be given of air paths for ventilation in the helmet 1 of the present embodiment.

When a wearer of the helmet 1 drives a motorcycle, due to a traveling stream, air flows from the front openings 21 of the shell 2 via the front ventilation holes 4 of the shock absorbing liner 3 to the inside air paths such as the inside grooves 6. Air near the parietal region of the wearer flows from the inside of the shock absorbing liner 3 through the inside air paths and is fed via the communicative holes 7 to the secondary flow paths 52 of the outside grooves 5. The flow path of air is then bended about 90° such that the air flows from the secondary flow paths 52 to the primary flow paths 51. The air flows through the primary flow paths 51 to the rear side and passes through the rear edge connecting sections 54 and then is exhausted from the rear opening 23 to the outside of the helmet 1 while the rear spoiler 22 is giving a negative pressure from the rear opening 23 to the outside.

Description will now be given of advantages of the present embodiment.

In the helmet 1 of the present embodiment, the communicative holes 7 to flow air from the inside air paths to the outside air paths of the shock absorbing liner 3 are disposed to penetrate through the shock absorbing liner 3. The openings on the outside surface of the communicative holes 7 are disposed except the positions of the primary flow paths 51. The openings on the outside surface are connected by the secondary flow paths 52 to the primary flow paths 51 of the outside air paths. The directions of the primary flow paths 51 are almost perpendicular to those secondary flow paths 52.

In the recent full-face helmet, the opening for the head of the wearer tends to be reduced in the diameter. Hence, the space between the head of the wearer and the inner side of the helmet tends to be small. Such an inner shape of the helmet enhances the fitting feeling of the helmet onto the head. Further, air does not easily enter the inside of the helmet so that the wearer is comfortable in the cold season, e.g., in winter. On the other hand, however, when the shutters arranged as air flow adjusting units in the front openings of the shell are opened in the hot season, e.g., in summer for ventilation of air in the helmet, the air flowing through the helmet generates sound. This leads to a fear that the sound reflects in the helmet to impair the comfort of the wearer.

In this connection, the present inventor has found that the sound generated by the air which flows from the inside air paths to the outside air paths of the shock absorbing liner to be exhausted to the outside of the helmet is conspicuously affected by the shapes of flow paths from the communicative holes to the outside air paths.

In the present embodiment, the air flow fed via the communicative holes 7 to the secondary flow paths 52 is vertically bended to be delivered from the secondary flow paths 52 to the primary flow paths 51. Hence, it is possible to remarkably reduce the sound such as whistling sound of wind in the helmet 1, and to thereby reduce the uncomfortable feeling of the whistling sound of wind while an appropriate ventilation is provided.

Also, in the present embodiment, the outside grooves 5 are disposed as outside air paths on the outer surface of the shock absorbing liner 3 and the rear spoiler 22 is arranged as a negative pressure generator or negative pressure generating unit just above the rear opening 23 as an outlet of the air flow from the outside grooves 5 to the outside of the helmet 1. Hence, while the spaces between the inside surface of the shell 2 and the outside grooves 5 are employed as the outside air paths, the flow rate of air passing through the inside air paths and the outside air paths of the helmet 1 is not lowered.

It is hence possible to provide the helmet 1 to appropriately fulfill ventilation.

Further, in the present embodiment, the inside grooves 6 are formed on the inner surface of the shock absorbing liner 3 and the communicative holes 7 are arranged to communicatively connect the bottoms of the inside grooves 6 to the secondary flow paths 52. This makes it possible to appropriately conduct ventilation through the inside air paths. That is, this prevents an event in which the spaces on the inner side relative to the shock absorbing liner 3 are filled with hairs of wearer to deteriorate ventilation in the inside air paths.

In the present embodiment, as can be seen from FIGS. 4, 7, and 8, the shock absorbing liner 3 includes an upper liner 31 and a lower liner 32 which are tightly fixed onto each other. The upper liner 31 and the lower liner 32 include materials such as styrene foam having different expanded ratios, to fulfill a shock absorbing function associated with the position of the shock absorbing liner 3 according to the designing. The inside grooves 6 are disposed on the inner surface of the shock absorbing liner 3 and the outside grooves 5 are arranged on the outer surface thereof.

Hence, irrespectively of the arrangement of these grooves, it is possible to freely design the contours of the upper liner 31 and the lower liner 32. That is, in a situation wherein the outside air paths are disposed in the inside of the shock absorbing liner 3, the shock absorbing liner 3 is configured to be divided at the portions of the outside air paths, and the grooves are disposed at the dividing positions on the opposing surfaces. In the present embodiment, since the grooves are formed on both surfaces of the shock absorbing liner 3 to configure the inside and outside air paths, it is not required to further divide the upper and lower liners 31 and 32 of the shock absorbing liner 3.

As a result, the cost of the shock absorbing liner 3 can be lowered, to thereby provide a low-cost helmet 1.

The embodiment described above is a favorable embodiment of the present invention, and the scope of the present invention is not limited only to the embodiment, but various changes may be made therein without departing from the gist of the present invention.

For example, in the description of the present embodying mode, the flow path direction of the secondary flow paths 52 is substantially vertical to that of the primary flow paths 51. This however does not restrict the angle between the flow paths 51 and 52. That is, only if it is possible to connect the primary flow paths 51 to the communicative holes 7 in which the openings on the outside surface are disposed at except the positions of the primary flow paths 51, the secondary flow paths 52 may be disposed to be connected to the primary flow paths 51 at a predetermined angle according to the designing.

The secondary flow paths 52 are not limited to the same width and the same depth in the flow path direction. For example, the width and the depth may be varied in the flow path direction such as taper. Also, there may be employed a configuration in which one communicative hole 7 is connected via two or more secondary flow paths 52 to the primary flow paths 51.

The cross-sectional shape of the communicative holes 7, when it is cut vertically to the flow path direction, are not limited to almost the shape of a circle, but the cross section may be in the shape of a polygon or a slit.

Even in a contour in which no inside groove 6 is disposed, the present invention is similarly applicable only if the inside air paths can be formed by using spaces between the head of the wearer and the inner side of the shock absorbing liner 3 by utilizing, for example, an inner pad, not shown, to make contact with the head of the wearer.

Further, the outside air paths are not limited to be placed between the inner surface of the shell 2 and the outside grooves 5 of the shock absorbing liner 3. For example, even in a configuration in which an additional layer is disposed between the shock absorbing liner 3 and the hard resin of the shell 2, the present invention is also applicable.

The outside air paths are not limited to the configuration including the outside grooves 5 of the shock absorbing liner 3. For example, even in a configuration in which the shock absorbing liner 3 is configured in two-layer structure including an inner layer and an outer layer such that by disposing grooves in the opposing surfaces respectively thereof, the outside air paths are arranged inside the shock absorbing liner 3, the present invention is similarly applicable.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A helmet, comprising a hard shell and a shock absorbing liner disposed on an inner side of the shell, the shell comprising front openings and rear openings, the shock absorbing liner, which is arranged inside the shell, comprising front ventilation holes that directly connect the front openings and an inner space existing at an inner surface of the shock absorbing liner so that air flows from the front openings to the inner space, outside air paths formed between an outer surface of the shock absorbing liner and the inner surface of the shell are connected to the rear openings, wherein the outside air paths and the front ventilation opening holes are not in direct connection with each other in the outer surface of the shock absorbing liner, and communicative holes that connect the inner space and the outside air paths through the shock absorbing liner so that the air flows from the inner space to the outside air paths, wherein the outside air paths comprise:

primary flow paths disposed on the outer surface of the shock absorbing liner that connect to the rear openings, and secondary flow paths disposed on the outer surface of the shock absorbing liner that connect to the communicative holes, wherein at least one secondary flow path branches off from each of the primary flow paths, wherein openings of the communicative holes connected to the secondary flow paths are configured so that the air flows from the inner space to the primary flow paths through the openings of the communicative holes and the secondary flow paths, and then flows through the primary flow paths along the inner surface of the shell and then flows out of the helmet through the rear openings, and wherein the front ventilation holes are disposed at independent paths in the shock absorbing liner from the outside air paths.

2. A helmet in accordance with claim 1, wherein the secondary flow paths have a flow path direction substantially perpendicular to a flow path direction of the primary flow paths.

3. A helmet in accordance with claim 1, wherein portions of the primary flow paths to which at least the secondary flow paths are connected are disposed to have a flow path direction substantially equal to a direction from a front side to a rear side of the helmet.

4. A helmet in accordance with claim 1, wherein the communicative holes are disposed as linear holes substantially perpendicular to a flow path direction of the outside air paths.

5. A helmet in accordance with claim 1, further comprising inside grooves disposed in the inner surface of the shock absorbing liner in a direction from a front side to a rear side of the helmet, wherein the communicative holes are disposed to connect bottoms of the inside grooves to the secondary flow paths.

6. A helmet in accordance with claim 1, further comprising outside grooves disposed in the outer surface of the shock absorbing liner, wherein the outside air paths include the outside grooves.

7. A helmet in accordance with claim 6, further comprising a negative pressure generator disposed in a proximity of the rear opening of the shell to generate pressure in a direction from the rear opening to the outside of the shell, wherein the outside air paths include the outside grooves and the inner side of the shell.

* * * * *